US005678360A

United States Patent [19]

Fort et al.

[11] Patent Number: 5,678,360

[45] Date of Patent: Oct. 21, 1997

[54] GUTTER LIQUID SEPARATOR

[76] Inventors: James H. Fort, 94 Quarry Rd., Granby, Conn. 06035; George C. Rannenberg, 27 Robin Dr., Collinsville, Conn. 06022

[21] Appl. No.: 466,350

[22] Filed: Jun. 6, 1995

[51] Int. Cl.[6] ..... E04D 13/076

[52] U.S. Cl. ..... 52/14; 52/12; 52/13; 52/16; 210/474

[58] Field of Search ..... 52/12, 13, 14, 52/16; 210/474

[56] References Cited

U.S. PATENT DOCUMENTS

| | | | |
|---|---|---|---|
| 603,611 | 5/1898 | Nye . | |
| 836,012 | 11/1906 | Cassen . | |
| 4,615,153 | 10/1986 | Carey | 52/12 |
| 4,757,649 | 7/1988 | Vahldieck | 52/12 |
| 4,801,377 | 1/1989 | Bolt | 52/12 X |
| 5,016,404 | 5/1991 | Briggs | 52/12 |
| 5,099,620 | 3/1992 | Carey | 52/12 |
| 5,302,283 | 4/1994 | Meuche | 210/162 |
| 5,437,138 | 8/1995 | Tuohey et al. | 52/16 X |
| 5,526,612 | 6/1996 | Wade | 52/12 |
| 5,535,554 | 7/1996 | Harris, Jr. | 52/16 X |
| 5,588,261 | 12/1996 | MacConochie | 52/12 X |

FOREIGN PATENT DOCUMENTS

| | | | |
|---|---|---|---|
| 2132657 | 7/1984 | United Kingdom | 52/12 |

*Primary Examiner*—Carl D. Friedman
*Assistant Examiner*—W. Glenn Edwards
*Attorney, Agent, or Firm*—Malcolm J. Chisholm, Jr.

[57] ABSTRACT

A gutter liquid separator is shown for separating liquid from non-liquid debris and for removing debris from a rain water gutter system secured to a roof of a structure. In a particular embodiment, the gutter liquid separator includes two main components; a debris discharge outlet and a liquid separator. The debris discharge outlet includes a flow surface, an inner and an outer wall extending up from the flow surface so that upstream edges of the flow surface, inner and outer walls are secured to a U-shaped gutter of the system. The debris discharge outlet also includes a debris drop-off edge that defines a drop-off plane passing through downstream edges of the flow surface, inner and outer walls. The liquid separator is secured to the debris discharge outlet and includes a liquid collection box secured to a bottom surface of the flow surface under the debris discharge outlet, and a liquid directing surface secured between the debris drop-off edge adjacent the downstream edge of the flow surface and a liquid inlet of the liquid collection box that directs liquid from the flow surface to the liquid collection box. The liquid collection box defines a liquid discharge outlet dimensioned to receive a downspout of the rain water gutter system. Liquid adheres to the liquid directing surface and flows into the liquid collection box, while debris flowing with the liquid drops off the debris drop-off edge out of the system.

8 Claims, 5 Drawing Sheets

GUTTER LIQUID SEPARATOR

TECHNICAL FIELD

The present invention relates to rainwater gutter systems for directing rain water run off from structures, and in particular relates to apparatus for separating liquid from non-liquid debris in gutters of a gutter system.

BACKGROUND OF THE INVENTION

Rain water gutter systems generally include gutters running at a slightly downward slope along an edge of a sloped roof of a structure to collect liquid runoff from a roof, and the gutters typically intersect with a downspout to direct the collected liquid downward for desired disposal of the liquid. Where the structure is near trees, or other debris generating objects, the gutter systems are susceptible to clogging, especially at the intersection of the gutter with the downspout. For example, twigs, pine needles and/or leaves are frequently blown into the gutters by wind, etc. and float downstream to the intersection with the downspout. Frequently a twig or leaf is longer that a discharge outlet defined in the gutter above the downspout, and the twig or leaf forms a bridge across the discharge outlet, and then other leaves or twigs collect there to ultimately form a clog, so that liquid in the gutter backs up, and flows out of the gutter along its length, defeating the purpose of the system.

Many inventions have been developed to alleviate the problem of gutter clogging, yet none have gained widespread acceptance. Such inventions can be separated into two general categories, namely—those having a debris separator element, and those utilizing a curved lip. Typical of the debris separator category element are the inventions shown in U.S. Pat. No. 5,302,283 to Meuche; U.S. Pat. No. 4,801,377 to Bolt; U.S. Pat. No. 4,615,153 to Carey; and United Kingdom Patent No. 2,132,657 to Cope. Meuche shows a leaf guard and screen assembly inserted into the discharge outlet to stop large debris from entering the outlet, yet large debris may still clog the outlet outside the assembly. Bolt shows an angled grate debris separator within the downspout which can have no effect on clogs above the separator at the discharge outlet. Carey shows a leader filter below the discharge outlet in the gutter for separating liquid from debris so only debris enters the downspout, but it too can have no effect on clogs above the leader filter at the discharge outlet. Cope shows a screen box having vertical walls around a screen over the downspout. Twig-like debris, however may easily catch in the screen to form a catch mechanism for leaves, etc., which in turn form a clog over the downspout.

Inventions typical of the curved lip gutter structures include U.S. Pat. No. 5,099,620 to Carey; U.S. Pat. No. 5,016,404 to Briggs; U.S. Pat. No. 4,757,649 to Vahldieck; U.S. Pat. No. 836,012 to Cassen, and U.S. Pat. No. 603,611 to Nye. All of the inventions disclosed in the curved lip category patents share in common a shield over the gutter to prohibit entry of debris, and a curve either on or adjacent to the shield that uses the adhesive quality of liquid run off to flow inward, toward the roof and into the gutter under and below the shield.

While such systems have proven successful in limiting debris clogs in gutters, they are not widely used because they are too expensive to construct and install on the variety of differing roof styles, and they are invariably very fragile, and easily break or deform upon contact with ordinary ladders, falling limbs, etc. For example, the distance between an outer edge of the gutter away from the roof and a drop point of the curved lip shield must be quite small to limit inflow of debris while permitting flow of water. A slight impact with a ladder or falling branch will easily cause the shield to bend and contact the outer edge of the gutter, thereby diverting flow of liquid run off out of the gutter, and defeating the purpose of the entire system.

The debris separator element inventions again all suffer from a common deficiency. In particular, it is quite common that a long twig enters a gutter that is longer than a width of the gutter (the width being parallel to an axis extending from the roof to an outer edge of the gutter). Such a twig in a heavy rain downpour easily floats downstream in the gutter, but simply cannot flow through a discharge outlet in the gutter and down a downspout. It then becomes lodged between opposed sides of the gutter over the discharge outlet, and therefore necessarily reduces the available space for entry of subsequent debris into the discharge outlet and downspout. The subsequent debris thereafter builds upon the long twig, and a clog inevitably obtains. No known rainwater gutter system is capable of adequately separating liquid runoff from debris so that the debris does not interrupt flow of the liquid into a downspout.

Accordingly it is the general object of the present invention to provide a gutter liquid separator that avoids the clog, cost, maintenance and repair problems of rain water gutter systems of the prior art.

It is a more specific object to provide a gutter liquid separator that may be readily utilized with existing rain water gutter systems.

It is another specific object to provide a gutter liquid separator that provides for removal of any non-liquid debris from the rain water gutter system.

It is yet another specific object to provide a gutter liquid separator that includes different embodiments for different debris environments.

The above and other advantages of this invention will become more readily apparent when the following description is read in conjunction with the accompanying drawings.

SUMMARY OF THE INVENTION

A gutter liquid separator is disclosed for separating liquid from non-liquid debris and for removing debris from a rain water gutter system secured to a roof of a structure. In a particular embodiment, the gutter liquid separator comprises: a debris discharge outlet including a flow surface, an inner wall extending up from an inner edge of the flow surface adjacent the roof, an outer wall opposed to the inner wall extending up from an outer edge of the flow surface so that upstream edges of the flow surface, inner and outer walls are secured to a U-shaped gutter of the system, the debris discharge outlet also including a debris drop-off edge that defines a drop-off plane passing through downstream edges of the flow surface, inner and outer walls; and, a liquid separator secured to the debris discharge outlet, the liquid separator including a liquid collection box secured to a bottom surface of the flow surface under the debris discharge outlet, the liquid collection box defining a liquid discharge outlet dimensioned to receive a downspout of the rain water gutter system, and the liquid separator also including a liquid directing surface secured between the debris drop-off edge adjacent the downstream edge of the flow surface and a liquid inlet of the liquid collection box that directs liquid from the flow surface to the liquid collection box.

During use of the gutter liquid separator, liquid run off from the roof flows into and through the gutter, across the flow surface of the debris discharge outlet, along the liquid directing surface into the liquid collection box under the flow surface of the debris discharge outlet where the liquid passes through the liquid discharge outlet and into the downspout of the rain water gutter system. When debris enters the gutter it flows downstream with the liquid run off through the gutter and across the flow surface and drop off edge of the debris discharge outlet where it is unrestricted by the inner or outer walls, and is free to fall by gravity out of the rain water gutter system.

In a curved lip embodiment of the gutter liquid separator, the liquid directing surface is in the shape of a curved lip, and in an inclined grate embodiment of the gutter liquid separator, the liquid directing surface is in the shape of an inclined grate. For environments that have twigs or needles from nearby trees (e.g., larch, fruit, or coniferous trees, etc.) as a contributor to gutter debris, the curved lip embodiment facilitates efficient passage of the twigs out of the system. For rain water gutter systems that have leaves from deciduous trees (e.g., maple, oak, etc.) as a major debris contributor, the inclined grate embodiment facilitates efficient passage of the leaves out of the system.

DESCRIPTION OF THE PREFERRED EMBODIMENTS

Figure 1:
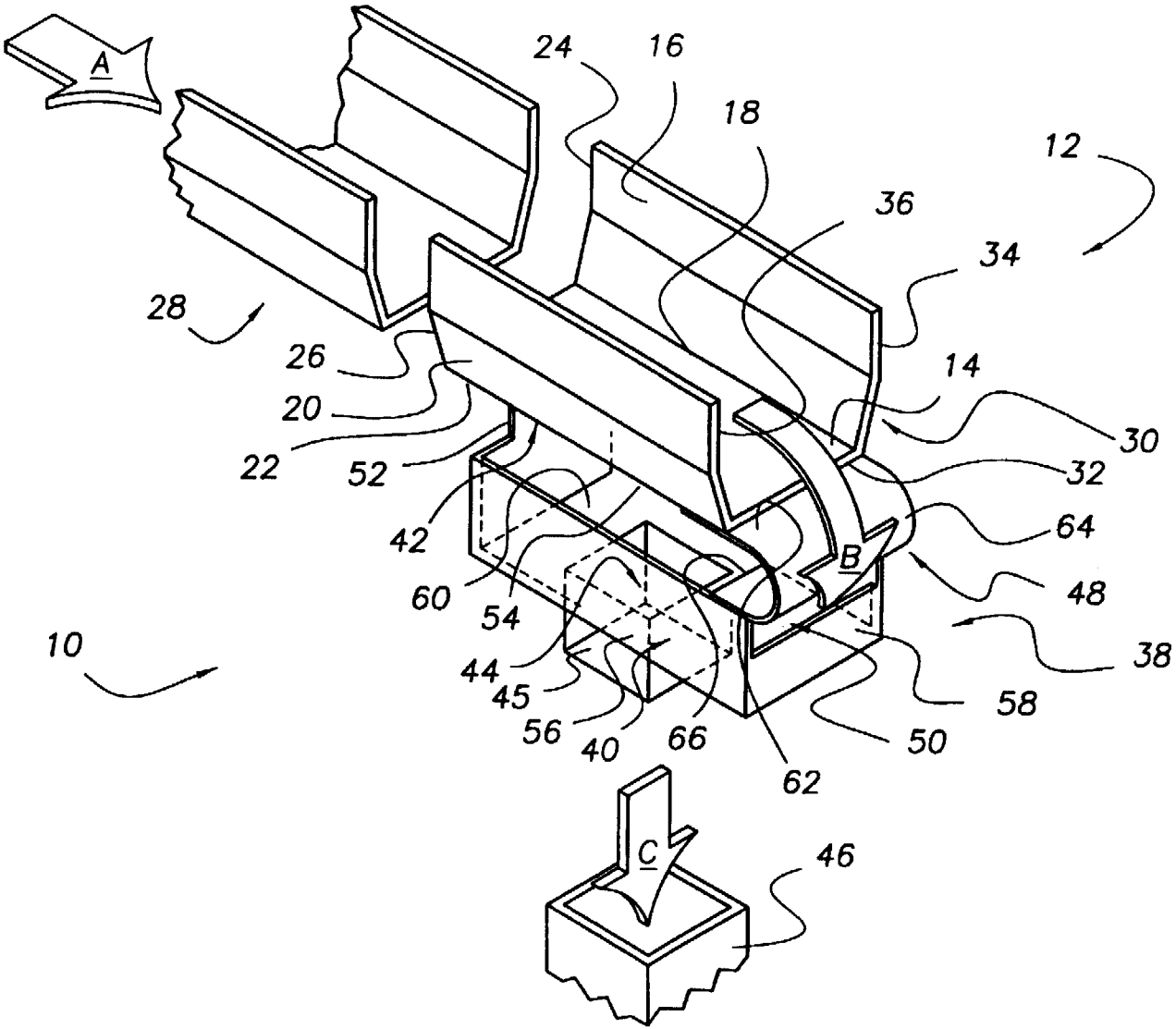
FIG. 1 is a perspective view of a gutter liquid separator constructed in accordance with the present invention showing a liquid collector under a debris discharge outlet.

Referring to the drawings in detail, a gutter liquid separator of the present invention is shown in FIGS. 1–4, and generally designated by the reference numeral 10. As best seen in FIG. 1, the gutter liquid separator 10 includes: a debris discharge outlet 12 having a flow surface 14, an inner wall 16 extending upward from an inner edge 18 of the flow surface, an outer wall 20 opposed to the inner wall 16 extending upward from an outer edge 22 of the flow surface, so that an upstream edge (not shown) of flow surface 14, an upstream edge 24 of the inner wall 16, and an upstream edge 26 of the outer wall 20 are secured to a U-shaped gutter 28 of a rain water gutter system (not shown), the debris discharge outlet 12 also having a debris drop-off edge 30 that defines a drop-off plane passing through a downstream edge 32 of flow surface 14, a downstream edge 34 of inner wall 16, and a downstream edge 36 of outer wall 20; and a liquid separator 38 having a liquid collection box 40 secured to a bottom surface 42 of the flow surface 14 under the debris discharge outlet 12, the liquid collection box 40 defining a liquid discharge outlet 44 (shown in phantom lines in FIG. 1) dimensioned to receive a downspout 46 of the rainwater gutter system, and the liquid separator also including a liquid directing surface 48 secured between the debris drop-off edge 30 adjacent the downstream edge 32 of the flow surface 14 and a liquid inlet 50 of the liquid collection box 40, so that the liquid directing surface 48 directs flow of liquid from the flow surface 14 to the liquid collection box 40 under the flow surface 14.

As shown in FIG. 1, the liquid collection box 48 is secured to the bottom surface 42 of the flow surface 14 by an upstream box wall 52, and an inner box wall 54, and the liquid collection box 48 completes a liquid containing enclosure with outer box wall 56 and downstream box wall 58, which four box walls 52, 54, 56, 58 join with a box floor 60 to define a liquid containing enclosure, liquid collection box 40. A downspout coupler 45 is shown secured within the liquid discharge outlet 44 defined within the box floor 60 of the liquid collection box 40.

By usage of the terms "upstream" and "downstream" herein, it is meant that "upstream" means in a direction directly opposed to a flow of liquid in the gutter 28 and gutter liquid separator 10, and "downstream" means in a direction of flow of liquid in the gutter 28 and gutter liquid separator. For convenience, liquid flow arrows are shown in FIGS. 1–5 to represent the direction of liquid flow, and the liquid flow arrows will be designated "A", "B", and "C" in the Figures to avoid any possible confusion, as the arrows are for orientation purposes, and do not form a part of the invention.

The gutter liquid separator 10 shown in FIG. 1 is a curved lip embodiment of the gutter liquid separator, because the liquid directing surface 48 is in the shape of a curved lip. The liquid directing surface 48 may be a liquid directing surface means for directing flow of liquid from the debris discharge outlet 12 to the liquid collection box 40, and may be in the form of the curved lip liquid directing surface 48 shown in FIG. 1, wherein the curved lip directing surface includes a liquid entry surface 62 affixed to the debris drop-off edge 30 adjacent the downstream edge 32 of the flow surface 14. The liquid entry surface 62 is a flat surface having no adjoining walls, and is disposed in tangential relationship to the flow surface 14.

The curved lip liquid directing surface 48 also includes an arcuate surface 64 adjacent the liquid entry surface 62 that bends downward away from a flow axis of the flow surface 14 and under the liquid entry surface 62 so that liquid such as rain water because of water's ordinary adhesive properties will adhere to the arcuate surface 64 against the force of gravity and flow under the liquid entry surface 62, while debris flowing with the liquid will drop by the force of gravity away from the arcuate surface 64, and out of the rain water gutter system. The arcuate surface 64 includes a drip edge 66 within the liquid inlet 50 of the liquid collection box 40, so liquid on the arcuate surface 64 flows to the drip edge 66, and then drops into the liquid collection box 40, where it ultimately flows through the liquid discharge outlet 44, downspout coupler 45 and through the downspout 46, out of the rain water gutter system. The drip edge 66 of the arcuate surface 64 is secured to the inner and outer box walls 54, 56, as shown in FIG. 1.

Figure 2:
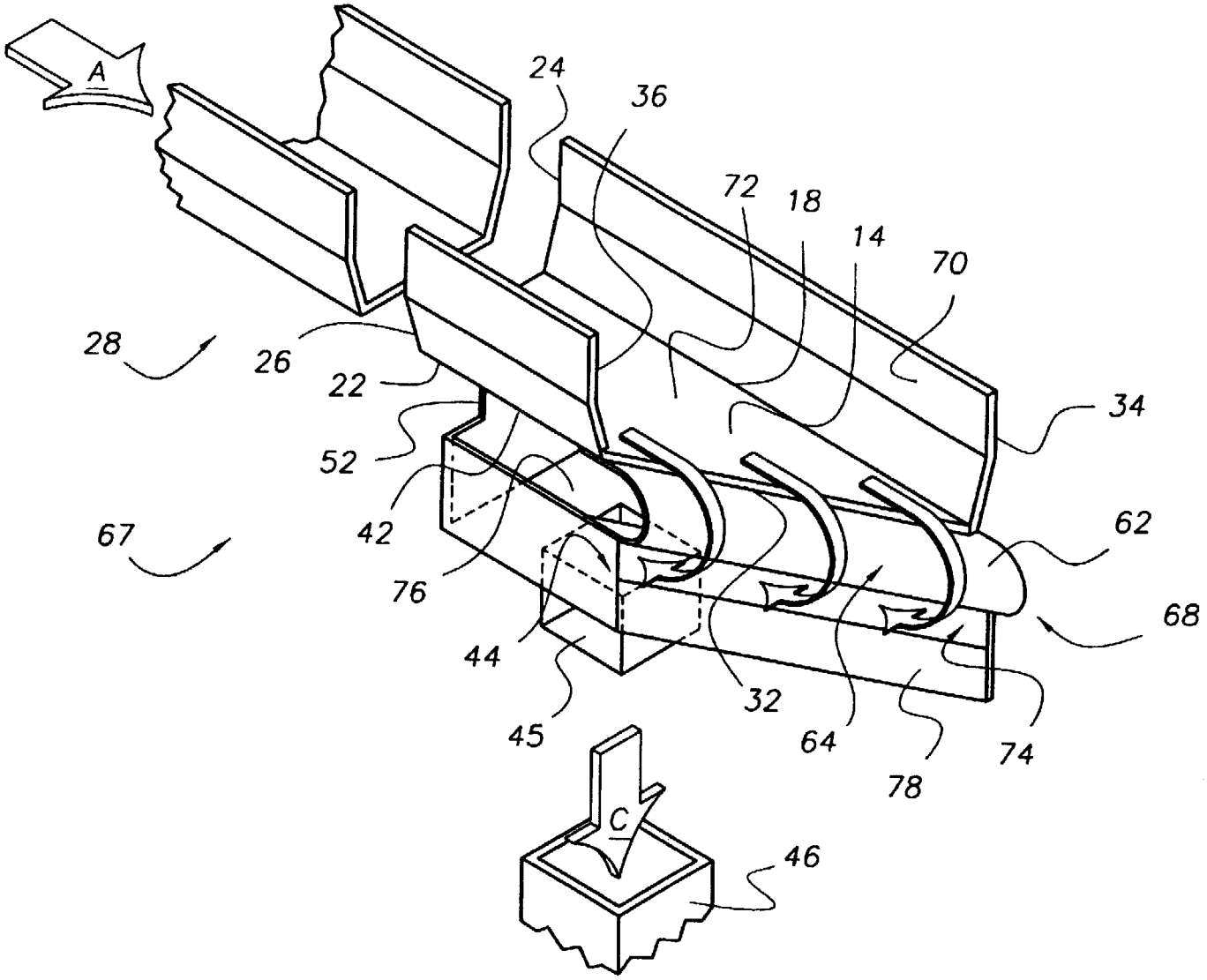
FIG. 2 is a perspective view of an angled curved lip embodiment of the gutter liquid separator of the present invention.

The liquid directing surface means also includes an angled curved lip embodiment 67 of the gutter liquid separator 10, shown in FIG. 2, wherein the liquid directing surface means is in the form of an angled curved lip liquid directing surface 68. In FIG. 2, the components of the invention that are identical are given the same number and need no further description herein. The components of the angled curved lip embodiment of the gutter liquid separator 10 that are different than the curved lip embodiment shown in FIG. 1 are an angled inner wall 70, angled flow surface 72, angled inner box wall 74, angled box floor 76, and angled downstream box wall 78. The drip edge 66 of the arcuate surface 64 of the angled curved lip emodiment 67 is secured to the angled inner box wall 74 and outer box wall 56, as shown in FIG. 2. As clearly seen in FIG. 2 those components are dimensioned to engage the angled curved lip liquid directing surface 68 so that a greater surface area is available to adhere more liquid passing through the gutter liquid separator 10. Tests have established that an optimal angle between an axis parallel to a flow axis of liquid passing through the debris discharge outlet 12 and an axis parallel to the drop-off plane of the angled curve lip embodiment 67 is approximately 30 degrees.

Figure 3:
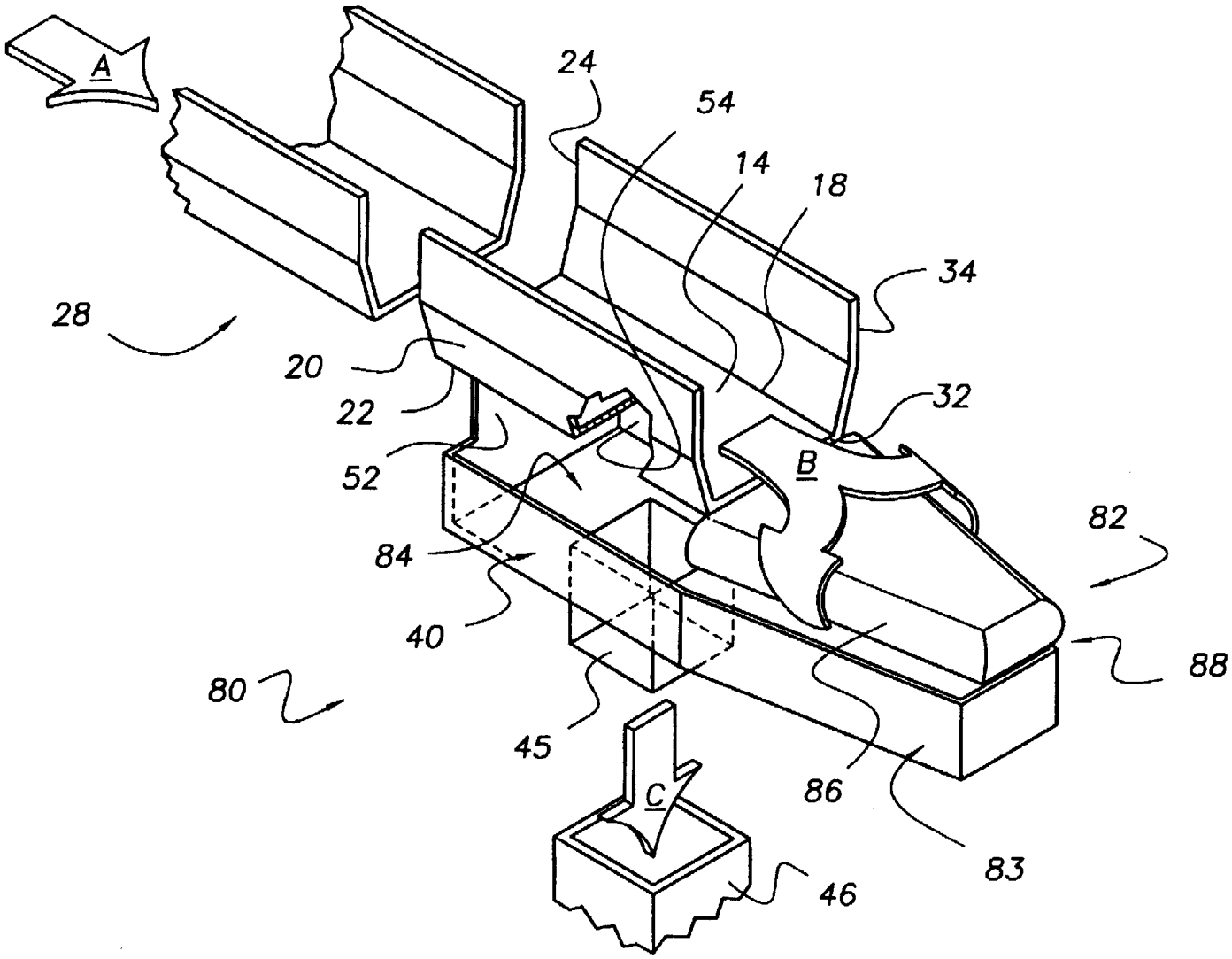
FIG. 3 is a perspective view of a double angled curved lip embodiment of the gutter liquid separator of the present invention.

Similarly in FIG. 3, a double angled curved lip embodiment 80 of the gutter liquid separator 10 is shown, wherein the liquid directing surface means is in the form of a double angled curved lip liquid directing surface 82. As with FIG. 2, the components of the invention that are identical to the gutter liquid separator shown in FIG. 1 are given the same number in FIG. 3, and need no further description. The components of the double angle curved lip embodiment 80 that are different include the double angle curved lip liquid directing surface 82, a double angle downstream wall 83, and a double angle box floor 84 of the liquid collection box 40. As is apparent from FIG. 3, the double angle curved lip liquid directing surface 82 includes the liquid entry surface 62 adjacent the debris drop-off edge 30 having no adjoining walls, and a triangle-shaped double angle arcuate surface 86 that curves away from the liquid entry surface to direct liquid into a triangle-shaped double angle inlet 88 defined between the double angle curved lip liquid directing surface 82 and the double angle downstream wall 83 of the liquid collection box 40.

Figure 4:
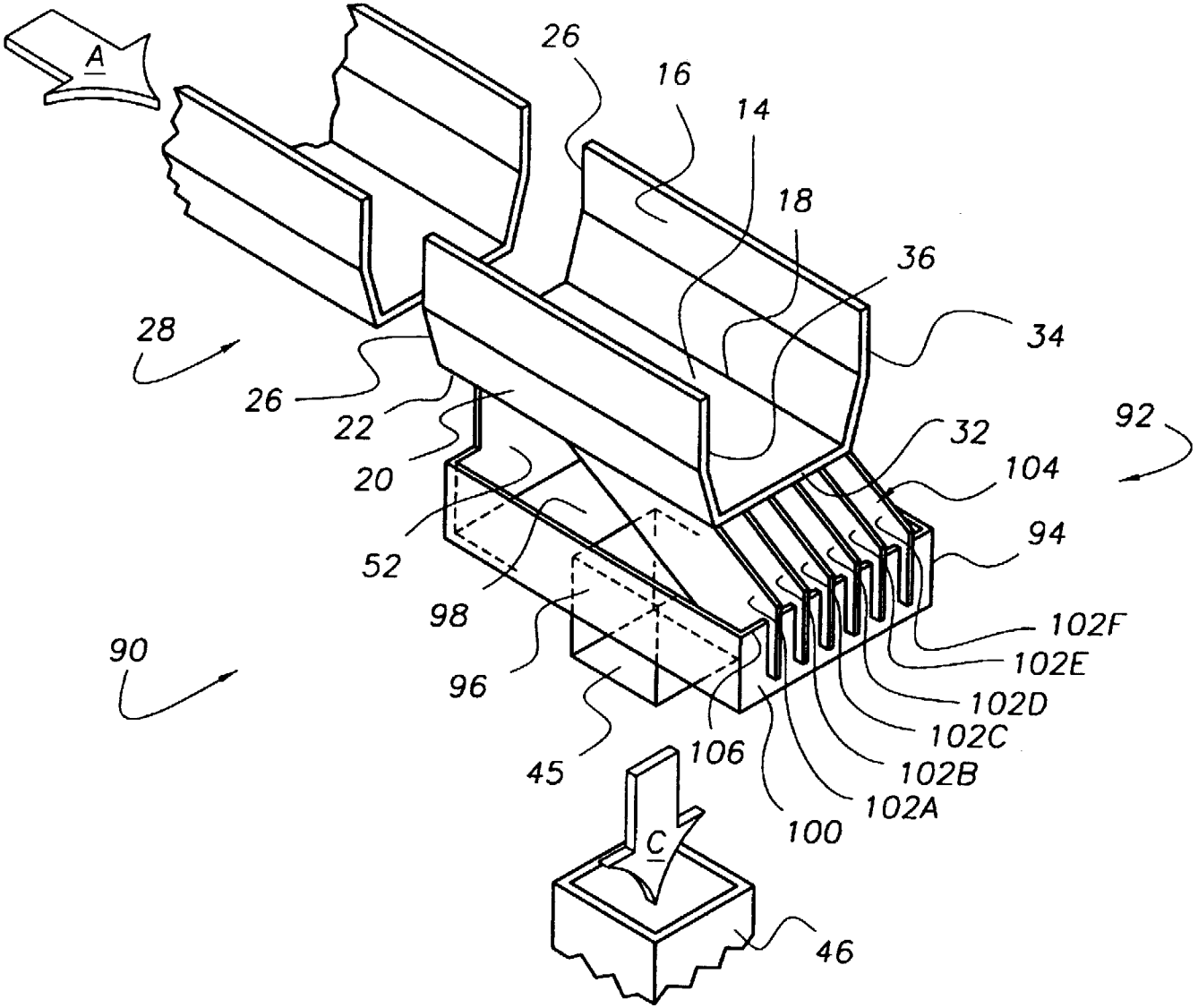
FIG. 4 is a perspective view of an inclined grate embodiment of the gutter liquid separator of the present invention.

As seen in FIG. 4, the gutter liquid separator 10 also includes and inclined grate embodiment 90, wherein the liquid directing surface means is in the form of an inclined grate 92 secured between the downstream edge 32 of the flow surface 14 and the liquid collection box 40. As with FIGS. 2 and 3, the components that are identical to the FIG. 1 embodiment of the gutter liquid separator are given the same reference numerals in FIG. 4, and need no further description. The components that are not identical to the FIG. 1 embodiment are the inclined grate 92, an inclined grate inner box wall 94, an inclined grate outer box wall 96, and inclined grate box floor 98, and an inclined grate downstream box wall 100. The inclined grate 92 includes a plurality of inclined struts 102A, 102B, 102C, 102D, 102E (hereafter referred to for convenience as "102A–102E") that extend between the flow surface downstream edge 32 adjacent the debris drop-off edge 30 and the inclined grate downstream box wall 100, and define an inclined grate inlet 104 to the liquid collection box 40 between the flow surface downstream edge 32 and inclined grate downstream box wall 100.

The inclined struts 102A–102E as seen in FIG. 4, are roughly planar and are disposed so their axes defined by their planes are parallel to the flow axis of liquid in the debris discharge outlet 12, and the struts 102A–102E are inclined downwardly (meaning in a direction toward the downspout 46) from the flow surface downstream edge 32 to the inclined grate downstream box wall 100 of the liquid collector box 40. Tests have established that an optimal angle of inclination for placement of the guide struts 102A–102E is about 45 degrees between an axis parallel to the flow axis of the liquid in the debris discharge outlet 12 and an axis between the flow surface downstream edge 32 and a top edge 106 of the inclined grate downstream box wall 100.

In use of the inclined grate embodiment 90 of the gutter liquid separator 10, liquid flows over the debris drop-off edge 30 of the debris discharge outlet 12 and flows by gravity into the inclined grate inlet 104 and through the liquid collection box 40 and into the downspout 46. When any debris floating or being moved through the debris discharge outlet 12 passes beyond the debris drop-off edge 30 the debris (not shown) is then unencumbered by any vertical walls and receives an additional increase in velocity as it moves over the inclined grate 92 until it passes beyond the grate 92 and moves downward by the force of gravity out of the rain water gutter system.

Figure 5:
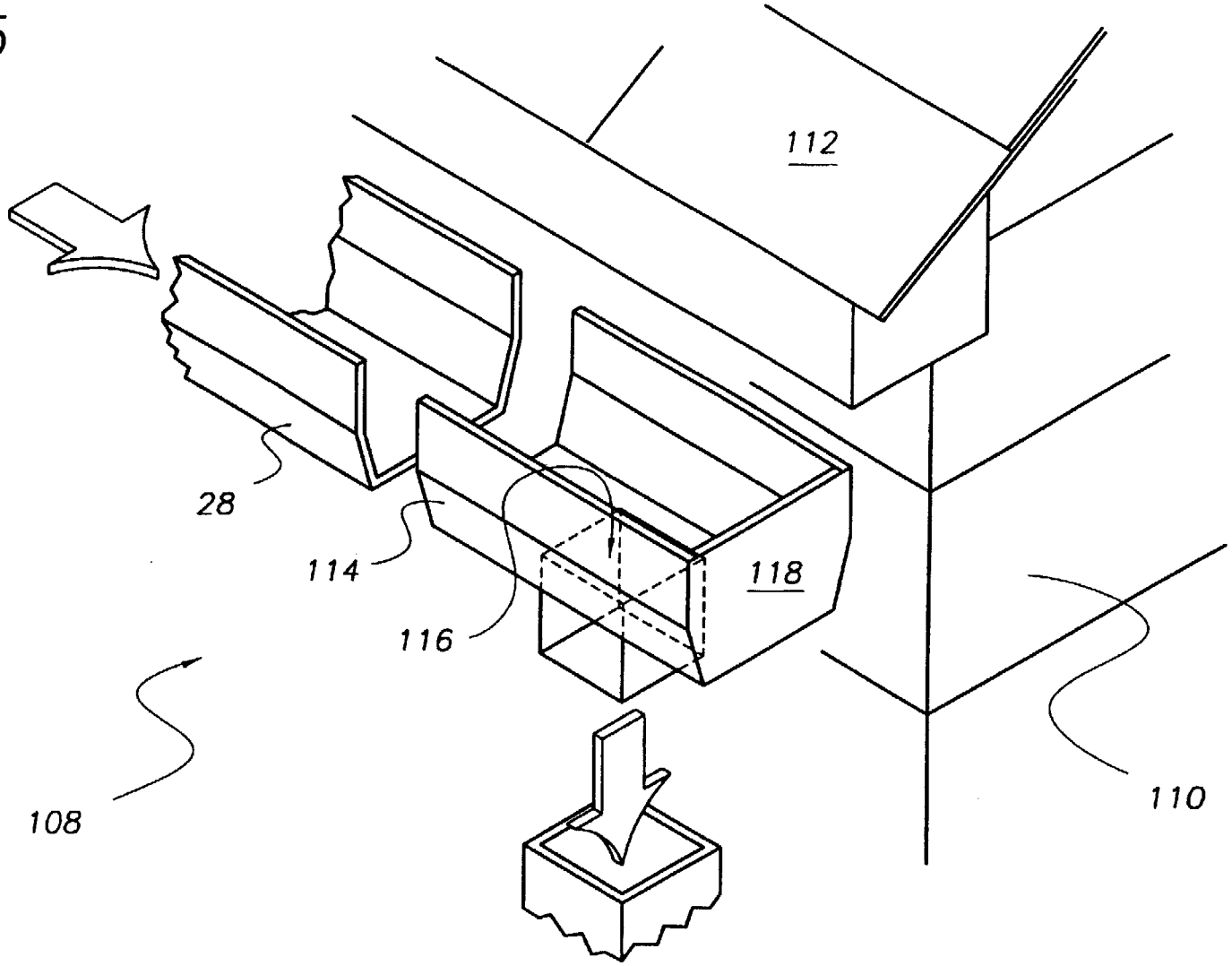
FIG. 5 is a partially exploded perspective view of a prior art rain water gutter system showing the system adjacent to a sloped roof of a structure.

As seen in FIG. 5, a standard rain water gutter system 108 is secured to a structure 110 below a sloped roof 112 so that rain water or related liquid flows into the gutter 28, and then downstream into a downspout junction box 114 that defines a standard liquid discharge outlet 116 (shown in phantom lines in FIG. 5) dimensioned to receive the downspout coupler 45 that directs the liquid into the downspout 46. The downspout junction box also includes a gutter end wall 118 that prohibits both liquid and debris from passing out of the downspout junction box 114 in a downstream manner except through the standard liquid discharge outlet 116. If a long twig or long piece of debris (not shown) having a longitudinal axis longer than a longest axis of the standard liquid discharge outlet 116 passes into the downspout junction box 114, it is virtually impossible for the long twig to pass through the discharge outlet 116. Such debris and other similar debris will inevitably form a clog over the discharge outlet 116 causing liquid to back up and flow out of the gutter 28, thereby defeating the purpose of the rain water gutter system 108. Even if the end wall 118 were removed, and a screen placed over the standard liquid discharge outlet 116, a long twig having a longitudinal axis longer than a transverse axis of the gutter 28 would inevitably have one end stick in the discharge outlet 116 while an opposed end of the stick would become wedged against a vertical wall of the downspout junction box 114, again leading to trapping of smaller debris, and eventually leading to a clog.

In contrast, all embodiments of the gutter liquid separator 10 of present invention would permit such moving long twig type of debris to move out of the debris discharge outlet 12. With curved lip 10, angled curved lip 67 and double angled curved lip 82 embodiments in particular, such long twig types of debris simply flow out of the separator 10. Because liquid moves into the liquid collection box 40 at points in all of those embodiments that is upstream of points debris falls out of the separator, it is virtually impossible for the debris to clog the downspout 46. Consequently, in environments where twig-types of debris is most common, the curved lip embodiments of the gutter liquid separator 10 are most appropriate. Some environments, however, have almost no twig-type of debris, and instead have primarily leaf-type of debris. In that environment the inclined grate embodiment 90 of the gutter liquid separator 10 is most appropriate, especially where the environment experiences sudden and severe rain downpours, because the inclined grate embodiment 90 catches more liquid in its liquid collection box 40 in such circumstances than the curved lip embodiments. Even with the inclined grate embodiment 90, however, a long twig-based clog is unlikely because after the twig passes the debris drop-off edge 30, no further walls constrain movement over or off the inclined grate 92. Additionally, in the event twig-type of debris is a problem, the inclined struts 102A–102E may be positioned closer to each other to limit the possibility of such twigs passing between the struts, and additional cross bars (not shown) could be placed over the struts in the nature of a screen to further restrict entry of twigs or any type of debris into the inclined grate liquid inlet 104.

The gutter liquid separator 10 of the present invention may be made of any materials commonly used in manufacture of rain water gutter systems, such as modern plastics, aluminum, etc.

Wile the present invention has been described and illustrated with respect to particular constructions of a gutter liquid separator, it should be understood by those skilled in the art that the present invention is not limited to those particular embodiments. For example, the liquid directing surface 48 could take any of a variety of shapes that direct liquid from the debris discharge outlet 12 to the underlying liquid collection box 40. Accordingly, reference should be made primarily to the attached claims rather than the foregoing description to determine the scope of the invention.

Having described the invention, what is claimed is:

1. A gutter liquid separator for separating liquid from non-liquid debris and for removing the non-liquid debris from a rain water gutter system secured to a roof or a structure, comprising:

a. a debris discharge outlet including a flow surface, an inner wall extending up from an inner edge of the flow surface adjacent the roof, and outer wall opposed to the inner wall extending up from an outer edge of the flow surface so that upstream edges of the flow surface, inner and outer walls are secured to a U-shaped gutter of the system, the debris discharge outlet also including a debris drop-off edge that defines a drop-off plane passing through downstream edges of the flow surface, inner and outer walls; and, b. a liquid separator secured to the debris discharge outlet, the liquid separator including a liquid collection box secured to a bottom surface of the flow surface under the debris discharge outlet, the liquid collection box defining a liquid discharge outlet dimensioned to receive a downspout of the system, and the liquid separator also including a liquid directing surface secured between the debris drop-off edge adjacent the downstream edge of the flow surface and a liquid inlet of the liquid collection box so that the liquid directing surface directs liquid from the flow surface to the liquid collection box, wherein the liquid directing surface comprises a curved lip liquid directing surface having a flat liquid entry surface affixed to the debris drop-off edge adjacent the downstream edge of the flow surface, and having an arcuate surface adjacent the liquid entry surface that bends away from a flow axis of the flow surface toward the liquid collection box and under the liquid entry surface, the liquid directing surface including a drip edge secured to inner and outer box walls of the liquid collection box, so that wherein liquid adheres to the arcuate surface and flows under the liquid entry surface into the liquid inlet of the liquid collection box.

2. The gutter liquid separator of claim 1, wherein the liquid directing surface comprises an angled curved lip liquid directing surface and the drop-off plane defined by the downstream edges of the flow surface, inner and outer walls is non-perpendicular with an axis parallel to a flow axis of liquid flowing through the debris discharge outlet, the angled curved lip liquid directing surface having a flat liquid entry surface affixed to the debris drop-off edge adjacent the downstream edge of the flow surface, and having an arcuate surface adjacent the liquid entry surface that bends away from a flow axis of the flow surface toward the liquid collection box and under the liquid entry surface the liquid directing surface including a drip edge secured to an angled inner box wall and an outer box wall of the liquid collection box so that wherein liquid adheres to the arcuate surface and flows under the liquid entry surface into the liquid inlet of the liquid collection box.

3. The gutter liquid separator of claim 1, wherein the liquid directing surface comprises a double angled curved lip liquid directing surface having a flat liquid entry surface affixed to the debris drop-off edge adjacent the downstream edge of the flow surface, and having a triangle-shaped double angle arcuate surface that curves away from a flow axis of the flow surface toward the liquid collection box and under the liquid entry surface so that liquid adheres to the arcuate surface and flows under the liquid entry surface into the liquid collection box.

4. The gutter liquid separator of claim 2, wherein an angle between an axis parallel to the drop off plane and an axis parallel to the flow axis is about thirty degrees.

5. A gutter liquid separator for separating liquid from non-liquid debris and for removing the non-liquid debris from a rain water gutter system secured to a roof or a structure, comprising:

a. a debris discharge outlet including a flow surface, an inner wall extending up from an inner edge of the flow surface adjacent the roof, and outer wall opposed to the inner wall extending up from the outer edge of the flow surfaces so that upstream edges of the flow surface, inner and outer walls are secured to a U-shaped gutter of the system, the debris discharge outlet also including a debris drop-off edge that defines a drop-off plane passing through downstream edges of the flow surface, inner and outer walls; and, b. a liquid separator secured to the debris discharge outlet, the liquid separator including a liquid collection box secured to a bottom surface of the flow surface under the debris discharge outlet, the liquid collection box defining a liquid discharge outlet dimensioned to receive a downspout of the system, and the liquid separator also including an angled curved lip liquid directing surface means secured between the debris drop-off edge adjacent the downstream edge of the flow surface and a liquid inlet of the liquid collection box for directing liquid from the flow surface to the liquid collection box.

6. The gutter liquid separator of claim 5, wherein the liquid directing surface comprises an angled curved lip liquid directing surface and the drop-off plane defined by the downstream edges of the flow surface, inner and outer walls is non-perpendicular with an axis parallel to a flow axis of liquid flowing through the debris discharge outlet, the angled curved lip liquid directing surface having a flat liquid entry surface affixed to the debris drop-off edge adjacent the downstream edge of the flow surface, and having an arcuate surface adjacent the liquid entry surface that bends away from a flow axis of the flow surface toward the liquid collection box and under the liquid entry surface, the liquid directing surface including a drip edge secured to an angled inner box wall and an outer box wall of the liquid collection box so that wherein liquid adheres to the arcuate surface and flows under the liquid entry surface into the liquid inlet of the liquid collection box.

7. The gutter liquid separator of claim 6, wherein an angle between an axis parallel to the drop off plane and an axis parallel to the flow axis is about thirty degrees.

8. The gutter liquid separator of claim 5, wherein the liquid directing surface means comprises a double angled curved lip liquid directing surface having a flat liquid entry surface affixed to the debris drop-off edge adjacent the downstream edge of the flow surface, and having a triangle-shaped double angle arcuate surface that curves away from a flow axis of the flow surface toward the liquid collection box and under the liquid entry surface so that liquid adheres to the arcuate surface and flows under the liquid entry surface into the liquid collection box.

* * * * *